United States Patent [19]

Frey

[11] 4,199,880

[45] Apr. 29, 1980

[54] COMBINATION SKI BOOT WALKER AND CARRIER

[76] Inventor: Russell J. Frey, 934 Marymere Dr., Oconomowoc, Wis. 53066

[21] Appl. No.: 947,579

[22] Filed: Oct. 2, 1978

[51] Int. Cl.[2] ..... A43B 5/00; A43B 3/10; A43D 5/00

[52] U.S. Cl. ..... 36/132; 36/7.5; 12/120.5

[58] Field of Search ..... 36/7.5, 7.6, 132, 136; 12/120.5

[56] References Cited

U.S. PATENT DOCUMENTS

| | | | |
|---|---|---|---|
| 2,747,300 | 5/1956 | Field | 36/7.5 |
| 3,183,535 | 5/1965 | McAusland | 12/120.5 |
| 3,590,410 | 7/1971 | Shields | 12/120.5 |
| 4,123,854 | 11/1978 | Pasich | 36/132 |

*Primary Examiner*—Patrick D. Lawson

*Attorney, Agent, or Firm*—Andrus, Sceales, Starke & Sawall

[57] ABSTRACT

A combination ski boot walker and carrier including a pair of sole portions, each to be attached to the sole of a downhill ski boot by heel and toe clamps. The sole portions have generally curved lower surfaces which facilitate walking in the rigid ski boots. Elastic straps are attached to both sides of each sole portion, and when used as a carrier, the straps on the sides of one sole portion are engaged with fasteners on the corresponding sides of the other sole portion to thereby interconnect the straps in a generally X-shaped configuration on both sides of the sole portions.

13 Claims, 7 Drawing Figures

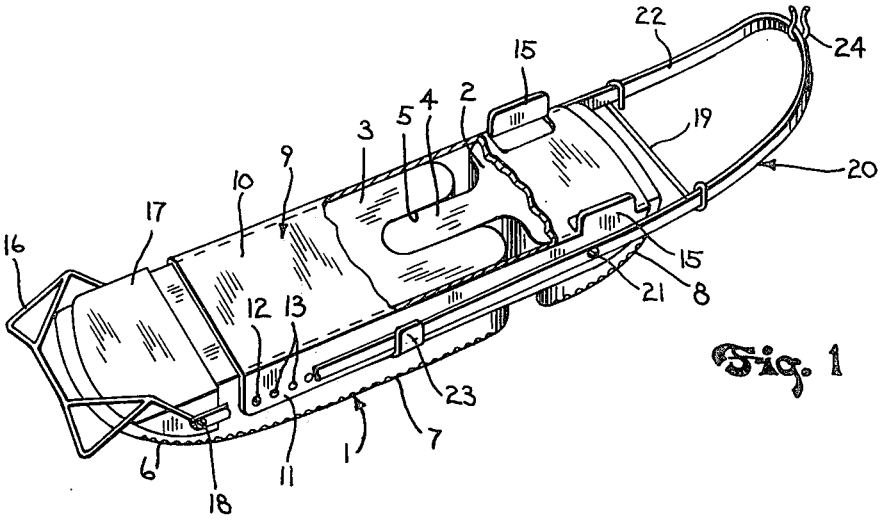
Fig. 1
Fig. 2
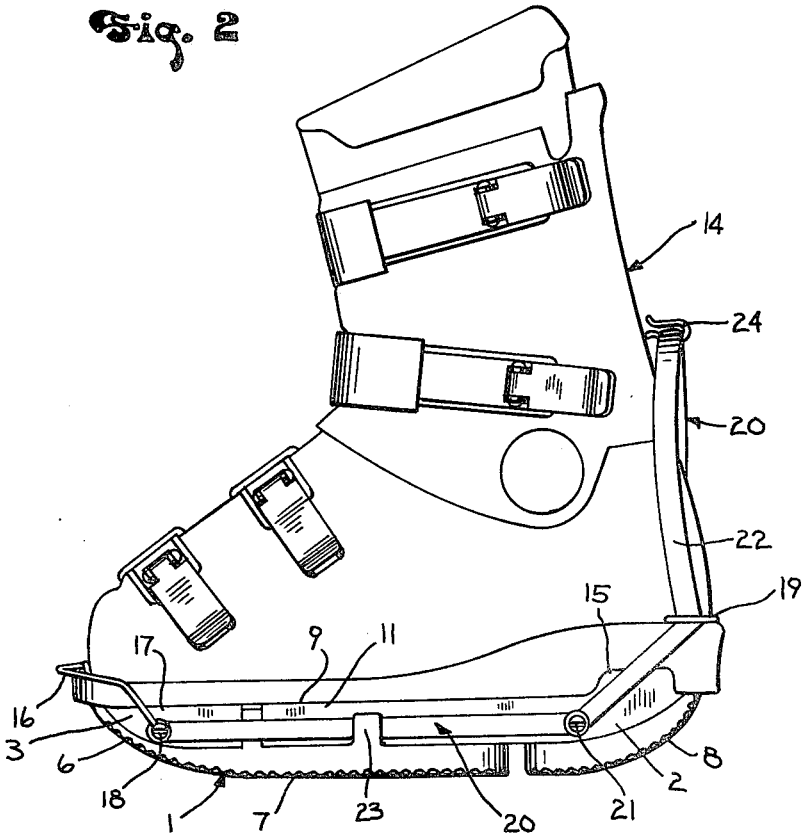

COMBINATION SKI BOOT WALKER AND CARRIER

BACKGROUND OF THE INVENTION

Downhill ski boots ae fabricated from rigid synthetic material so that the ankle is rigidly supported in a fixed position relative to the sole of the foot to enable the skier to exercise positive control over the action of the skis. With this type of ski boot, characterized by an inflexible sole and ankle support, walking is extremely difficult. Loosening of the boot clamps enables the foot to move within the boot, but walking with the clamps loosened can cause chafing and blistering of the foot if any extended walking is required.

In the past, walking blocks have been used for attachment to shoes. For example, in U.S. Pat. No. 2,810,213 semi-cylindrical blocks have been attached to street shoes for purposes of amusement, because of the peculiar walking action that results from use of the semi-cylidnrical blocks.

Walking blocks have also been used with downhill ski boots as shown in U.S. Pat. No. 3,665,620. In that patent generally rectangular blocks are secured to the central portion of the sole of the ski boot which enables the skier to walk with a type of rocking motion. However, the small walking blocks shown in U.S. Pat. No. 3,665,620 are relatively unstable, making walking difficult, particularly in slippery areas, and require frequent attachment and disattachment. Furthermore, the blocks being a separate item, require storage when not being used for walking.

SUMMARY OF THE INVENTION

The invention is directed to a novel combined downhill ski boot walker and carrier. In accordance with the invention, the device includes a pair of sole portions, each adapted to be attached to the sole of the ski boot by heel and toe clamps. The lower surface of each sole portion has a generally curved configuration, enabling the skier to walk with a rocking type of motion. An adjustment is provided for various sized ski boots so that the device can be extended or contracted to the desired boot size.

In order to use as a ski boot carrier, elastic straps are attached to the sides of each sole portion, and the straps extend rearwardly beyond each sole portion and are connected together in a loop to form a carrying handle. When used as a boot carrier, the sole portions are placed together in contiguous relation and the straps on one sole portion are engaged with a clip or a snap fastener on the corresponding sides of the other sole portion to connect the straps in a generally X-shaped configuration on each side of the sole portions. By bringing the two looped rear ends of the straps together as a handle, the boots can be readily carried.

When attached to the ski boots, the invention provides a functional walking device which aids in walking in downhill ski boots. The device can be readily converted to a boot carrier without the need for any auxiliary parts or components, and as a boot carrier, it will stand upright on the toe clamps.

In one form of the invention, the heel clip is carried by the elastic strap, and is designed such that when the heel clamp is engaged with the boot heel, the rear looped end of the strap will be urged upwardly into engagement with the rear of the boot in a position where it will not interfere with walking. When used as a boot carrier, the two looped ends of the straps can be brought together to serve as a handle for carrying.

In a second form of the invention, a toggle-type of heel clamp is used and a carrying strap is retained on each heel clamp. When used as a boot carrier, the straps are unfastened from the heel clamps and connected together to form a carrying handle.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the combination ski boot walker and boot carrier of the invention with parts broken away;

FIG. 2 is a side elevation showing the device as attached to a ski boot and used as a walker;

DESCRIPTION OF THE PREFERRED EMBODIMENT

Figure 3:
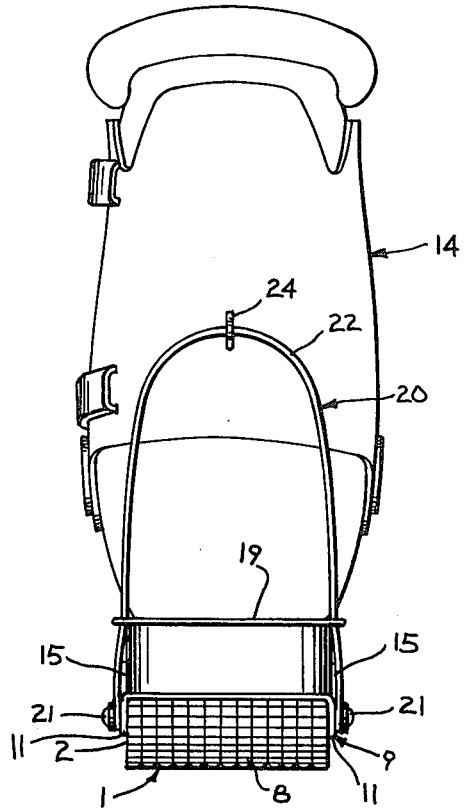
FIG. 3 is a rear view of the structure shown in FIG. 2.

FIGS. 1–4 illustrate a combination downhill ski boot walker and carrier which comprises a pair of sole portions 1, each of which is adapted to be attached to the sole of a ski boot. To provide adjustability to accommodate varying sizes of boot, the sole portion 1 is formed of a pair of interlocked or dovetailed sections 2 and 3, As best shown in FIG. 1, section 2 is provided with a longitudinally extending projection 4 which is received within a central slot 5 in section 3. With this type of dovetail connection, the sections 2 and 3 can be moved longitudinally relative to each other to thereby increase or decrease the length of the sole portion 1.

The sole portion 1 is preferably formed of resilient plastic material to reduce the impact when walking, and the lower surface, as illustrated, can be provided with ribs or other types of surface irregularities to provide traction when the device is used as a walker.

The lower surface of the sole portion 1 is generally curved as illustrated in FIG. 2. More specifically, the toe portion 6 of the lower surface is curved, while the central portion 7 is also curved but has a greater radius of curvature than that of the toe section 6. The heel portion 8 of the lower surface is generally straight. It has been found that this configuration of the lower surface of the sole portion 1 provides the most desirable rocking-type of movement when walking with the rigid ski boots.

The sections 2 and 3 of the sole portion 1 are connected together by an inverted U-shaped channel-member 9 having an upper surface 10 and a pair of side flanges 11 which extend downwardly along the sides of the sections 2 and 3. The flanges 11 of each channel 9 are secured to the sections 2 and 3 through screws 12 and the forward screw 12 is adapted to be received in one of the series of holes 13 formed in the side flange 11 to provide the necessary adjustment for length for the sole portion.

To aid in retaining the heel of the boot 14 on the sole portion, a pair of ears 15 project upwardly from the side edges of the channel 9 adjacent the heel. The ears 15 can be cut out portions of the channel, as shown, and serve to prevent lateral movement of the boot heel relative to the sole portion 1 of the walker.

The toe of the ski boot 14 is secured to the sole portion 1 through a toe clamp 16 which is pivoted to the side flanges of a toe channel 17 by screw 18. As best shown in FIG. 1, the forward or outer end of toe flap 16 is generally square so that when the device is used as a boot carrier, the boots will stand in an upright position on the ends of the toe clamps 16.

The heel of the boot 14 is secured to the sole portion 1 through a wire heel clamp 19 which is secured to a generally U-shaped elastic strap 20. The strap 20 is fastened to the sides of the sole portion 1 by the screws 21 and the screws 18, and as best shown in FIG. 1, the strap extends rearwardly beyond the sole portion 1 in the form of a loop 22. The wire heel clamp 19 is secured between the side portions of the strap and is located immediately adjacent the rear end or heel of the sole portion 1.

The wire heel clamp 19 is offset from the strap, as best shown in FIG. 1, and when the clamp 19 is secured to the heel of the boot the offset relationship will urge the looped outer portion of the strap upwardly into engagement with the rear portion of the boot, as illustrated in FIG. 2, where it will not interfere with walking.

Figure 4:
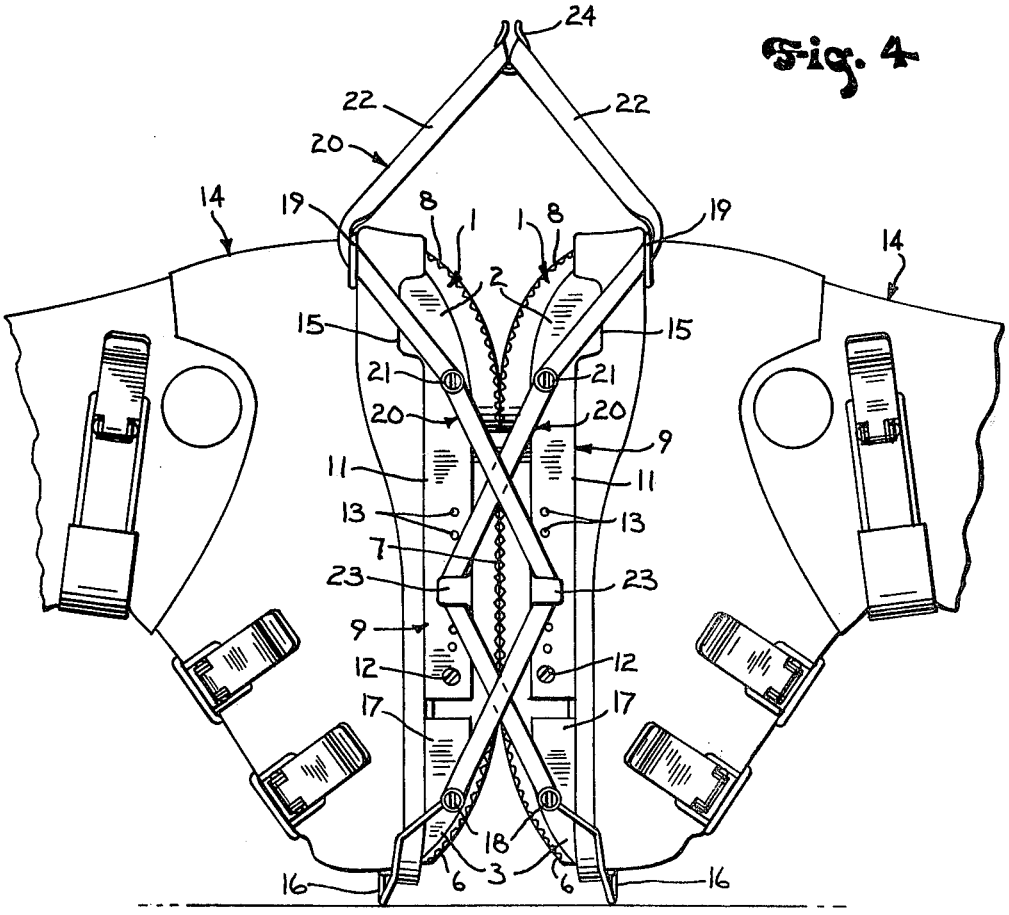
FIG. 4 is a side elevation of the device as used as a boot carrier.

When the device is to be used as a boot carrier, the soles 1 are brought into mating engagement as shown in FIG. 4, and the elastic straps 20 along each side of the sole are stretched and engaged with clips 23 mounted on the side flanges 11 of channels 9 of the other sole portion 1. With this connection, the straps 20 are in a generally X-shaped configuration on either side of the sole portion 1 which firmly holds the sole portions together. The outer loop portions 22 of the straps 20 can be brought together to form a carrying handle and a clip 24 can be associated with one of the looped ends 22 and engaged with the other loop end to hold the loops into a carrying handle configuration.

As previously mentioned, when used as a carrier the boots will stand upright on the outer ends of the toe clamps 16, as shown in FIG. 4.

With the construction shown in FIGS. 1–4, the device can be converted from a boot walker to a boot carrier by merely engaging the straps 20 of one sole portion 1 with clips 23 on the other sole portion and it is not necessary to utilize any auxiliary fasteners or components in making the conversion.

Figure 5:
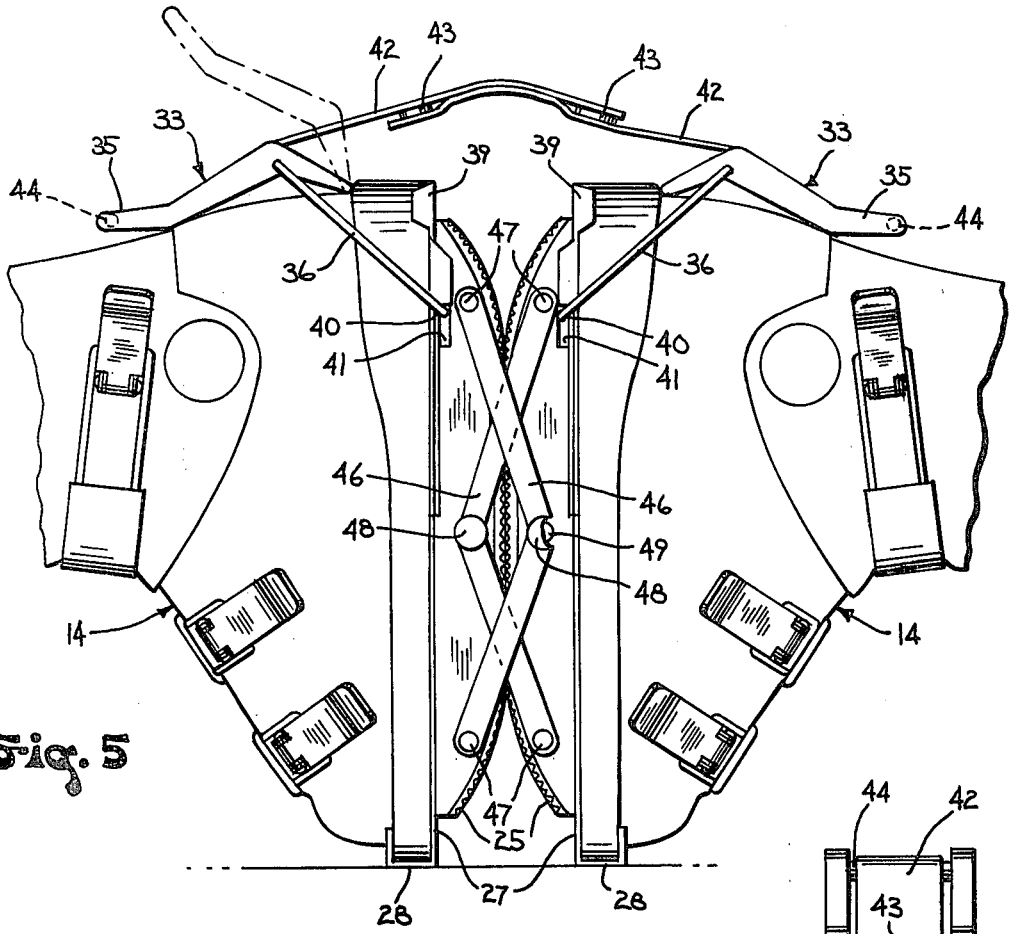
FIG. 5 is a view similar to FIG. 4 showing a modified form of the invention.
Figure 6:
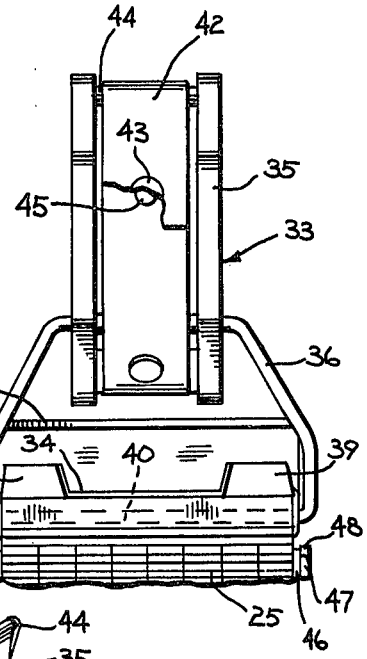
FIG. 6 is a rear view of the clamp used in the embodiment of FIG. 5.

As shown in FIGS. 5 and 6, the device includes a sole portion 25, similar in outer configuration to the sole portion 1. A toe clamp assemby 26 is secured to the upper surface of sole portion 26 and includes a flat body section 27, and a channel-shaped toe clip 28 which is adapted to engage the toe of the boot. The outer end of the toe clip 28 is square to enable the device, when used as a boot carrier, to stand upright as shown in FIG. 5.

To provide an adjustment for various sized boots, the body section 27 is formed with a series of holes 29 which register with holes in the sole portion 25. By sliding the toe clamp 26 along the sole portion 25, certain holes 29 will be brought into registry with holes in the sole portion, and the toe clamp can be secured in the proper position by use of screws 30 which are inserted through the aligned holes.

The central portion of the upper surface of the sole portion 25 is recessed and a surface plate 31 is secured within the recess by screws 32.

Secured to the rear of the sole portion 25 is a heel clamp assembly 33 including a base plate 34 and a heel clamp 35 which is pivotally attached to the base plate 34 through a U-shaped bracket 36.

As in the case of toe clamp assembly 26, the heel clamp assembly 33 is adjustably connected to sole portion 25 by a series of adjusting holes 37 that can be aligned with holes in sole portion 25. Screws 38 are inserted through the aligned holes to lock the heel clamp assembly in the desired position.

To aid in retaining the heel of the boot on the plate 34, a pair of ears or tabs 39 extend upwardly from the side edges of the plate and engage the sides of the boot.

To lock the heel clamp 35 to the heel of the boot, the lower end of the clamp is positioned against the boot heel and the clamp is then pivoted upwardly to the full line position, shown in FIG. 5, to an over-center position. During this movement, the web or connecting portion 40 of bracket 36 can move within the recess 41 in the sole portion 25 to accommodate this toggle action as the clamp moves through the on-center position to the over-center position.

In this embodiment, a strap 42 is associated with each heel clamp assembly 33. One end of the strap 42 is attached to the heel clamp 35, while the opposite end of the strap carries a snap fastener 43.

Figure 7:
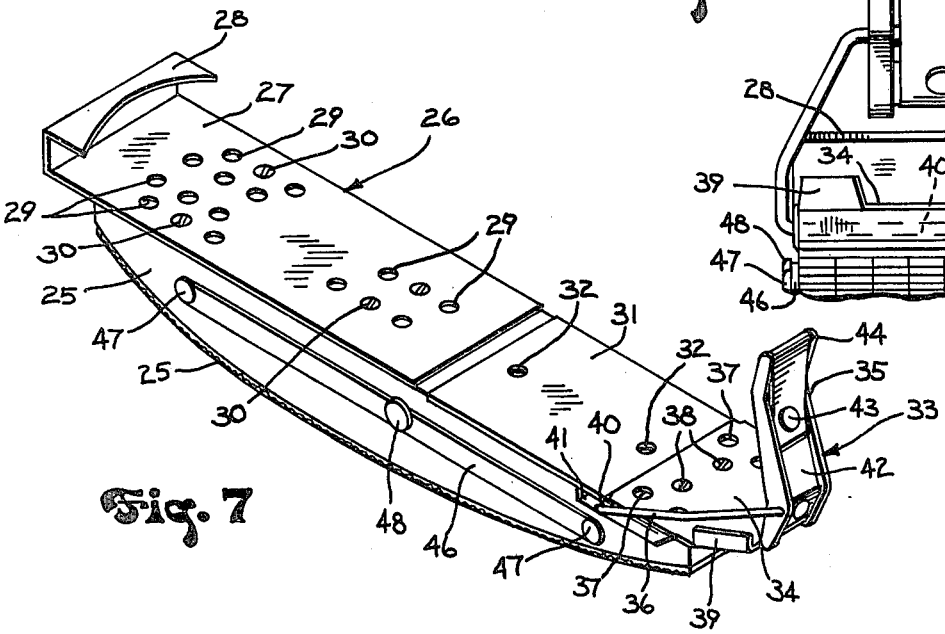
FIG. 7 is a perspective view of the device of FIG. 5.

To prevent straps 42 from dangling when the device is used as a walker, each strap may be stored by doubling it back over a rod 44 in the respective clamp 35. The fastener at the free end of the strap can then be engaged with a snap 45 located on the central portion of the strap. FIGS. 6 and 7 show the strap in a stored position where it will not interfere with walking.

When used as a carrier, the straps 42 can be disengaged from the rods 44 and the end fastener 43 on one strap can be engaged with the central fastener 45 of the other strap to form a carrying handle, as shown in FIG. 5.

An elastic strap 46 is secured by screws or other fasteners 47 to each side of the sole portion 25. Attached to the central portion of each strap 46 is a snap fastener 48 which is adapted to engage a mating fastener 49 on the side of the sole portion 25. When used as a carrier, as illustrated in FIG. 5, the fastener 48 associated with the strap 46 on one sole portion 25 is crossed over and connected to the fastener 49 on the other sole portion so that the straps are in an X-shape configuration. The resiliency of the straps 46 will hold the sole portions 25 in firm engagement.

The invention provides a device which has a dual function. It can be used as a walker to facilitate walking in downhill ski boots, and secondly it can be used as a boot carrier. Conversion from a walker to a carrier can be made without the necessity of attaching or detaching any auxiliary parts or components.

I claim:

1. A combination downhill ski boot walker and boot carrier, comprising a pair of sole portions each having a generally curved lower surface to facilitate walking when used as a walker, attaching means for attaching each sole portion to a ski boot, flexible straps extending along the sides of each sole portion, fastening means disposed on each side of each sole portion, when used as a carrier said sole portions being disposed in engaging relation with the strap on one side of one sole portion being engaged with the fastener on the corresponding side of the other sole portion whereby said straps are in a generally X-shaped configuration to connect said sole portions together.

2. The combination walker and carrier of claim 1, wherein the straps that extend along the sides of each sole portion project beyond the rear end of the sole portion and are connected together in the form of a loop.

3. The combination walker and carrier of claim 1, wherein the straps that extend along the sides of each sole portion project beyond the rear end of the sole portion and said attaching means includes a heel clamp disposed rearwardly of the sole portion, said heel clamp being connected between the projecting ends of the straps.

4. The combination walker and carrier of claim 3, wherein said heel clamp includes a transversely extending clamping member offset from the connections of the heel clamp to the projecting ends of said straps, whereby engagement of the heel clamp with the heel of the boot will urge the projecting ends of the strap toward the boot where it will not interfere with walking.

5. The combination walker and carrier of claim 1, wherein the flexible strap is formed of elastic material.

6. The combination walker and carrier of claim 1, wherein each strap is connected to the corresponding sole portion adjacent the front end of the sole portion and adjacent the rear end of the sole portion, said fastening means being located between said connections.

7. The combination walker and carrier of claim 6, wherein said fastening means comprises an upwardly extending projection on the side of the sole portion, the strap on one sole portion engaging the projection on the other sole portion to hold the sole portions together in the X-shaped configuration.

8. The combination walker and carrier of claim 6, wherein said fastening means comprises a first fastener element on said sole portion and each strap has a second fastener element engageable with the first fastener element on the other sole portion to hold the sole portions together in the X-shaped configuration.

9. The combination walker and carrier of claim 1, wherein said attaching means includes a toe clamp and a heel clamp, said combination including means for varying the spacing between the toe clamp and heel clamp to accommodate boots of different sizes.

10. The combination walker and carrier of claim 9, wherein said heel clamp is a toggle clamp movable to an over-center position to clamp the boot heel to the sole portion.

11. The combination walker and carrier of claim 9, and including a flexible band secured to each heel clamp, and connecting for connecting the bands together to form a carrying handle when the device is used as a boot carrier.

12. The combination walker and carrier of claim 11, and including means for securing the band in overlapping relation on said heel clamp so that the band will be retained within the confines of the heel clamp and will not drag when the device is used as a walker.

13. The combination walker and carrier of claim 9, wherein said attaching means includes a toe clamp and a heel clamp, the toe clamp of each sole portion having a straight front edge whereby said edges rest on a supporting surface to support the device in an upright position when assembled as a boot carrier.

* * * * *

UNITED STATES PATENT AND TRADEMARK OFFICE

CERTIFICATE OF CORRECTION

PATENT NO. : 4,199,880

DATED : APRIL 29, 1980

INVENTOR(S) : RUSSELL J. FREY

It is certified that error appears in the above-identified patent and that said Letters Patent are hereby corrected as shown below:

Column 4, After Line 61, insert the following paragraph:

---Various modes of carrying out the invention are contemplated as being within the scope of the following claims particularly pointing out and distinctly claiming the subject matter which is regarded as the invention.---

Signed and Sealed this

*Nineteenth* Day of *August 1980*

[SEAL]

*Attest:*

SIDNEY A. DIAMOND

*Attesting Officer*

*Commissioner of Patents and Trademarks*